US006276252B1

(12) United States Patent
Dionne

(10) Patent No.: US 6,276,252 B1
(45) Date of Patent: Aug. 21, 2001

(54) AMMUNITION CHAMBERING MECHANISM FOR AUTOMATIC FIREARMS

(75) Inventor: Sylvain Dionne, St-Augustin—Mirabel (CA)

(73) Assignee: SNC Technologies Inc. (CA)

( * ) Notice: Subject to any disclaimer, the term of this patent is extended or adjusted under 35 U.S.C. 154(b) by 0 days.

(21) Appl. No.: 09/310,749

(22) Filed: May 13, 1999

Related U.S. Application Data

(63) Continuation-in-part of application No. 08/863,078, filed on May 23, 1997, now abandoned.

(51) Int. Cl.[7] ..... F41A 21/48

(52) U.S. Cl. ..... 89/29; 89/14.05; 89/163; 42/77

(58) Field of Search ..... 89/14.05, 16, 29, 89/163, 195, 196; 42/76.02, 77

(56) References Cited

U.S. PATENT DOCUMENTS 889,279 * 6/1908 Warnant ..... 89/196
1,396,832 * 11/1921 Graham ..... 42/76.02

* cited by examiner

*Primary Examiner*—Stephen M. Johnson
(74) *Attorney, Agent, or Firm*—David J. French

(57) ABSTRACT

A training barrel for conversion of a firearm from normal barrel/slide partial locking operation to unlocked slide blow-back operation has an insert which provides a guide ramp for chambering rounds during the reload cycle. The guide ramp compensates for the absence of rearward displacement of the barrel when the firearm is converted to a training configuration. Such insert may be assembled into the weapon without modification to the slide or frame of said weapon.

4 Claims, 3 Drawing Sheets

AMMUNITION CHAMBERING MECHANISM FOR AUTOMATIC FIREARMS

This is a Continuation-In-Part application of application Ser. No. 08/863,078 filed May 23, 1997 now abandoned.

FIELD OF THE INVENTION

This invention relates to the field of firearms and provisions for modifying semi-automatic firearms for training purposes. In particular, it relates to reliable chambering of ammunition in blow-back firearms that have been modified to fire low-energy ammunition.

BACKGROUND TO THE INVENTION

In military and police firearms applications almost all of the ammunition consumed is used in training. For some training purposes, however, normal ammunition is not adequate. An alternative type of known training ammunition, represented by U.S. Pat. No. 5,359,937 (adopted herein by reference), fires a low-mass projectile relying on a special, low-energy cartridge designed to provide cycling of suitably-modified, recoil-operated automatic weapons.

An advantage of the low-energy training ammunition is that it has a shorter range and lower penetration capacity than standard ammunition. This permits use of smaller, less secure firing ranges as training facilities. If standard ammunition were accidentally employed in these facilities, unexpected dangers would arise from the increased striking power and range of standard ammunition.

The weapon modifications required to permit cycling while firing low-energy training ammunition generally include replacing or modifying the barrel and sometimes replacing or adding one or two other components, depending on the weapon involved. These modifications also serve to increase safety. For example, in 9 mm automatic firearms, the calibre of the substitute training barrel may be smaller than the diameter of the projectiles in standard 9 mm ammunition. If an attempt is made to chamber a standard round in such a training-adapted firearm, the barrel will not normally admit entry of the standard projectile. This ensures that such modified weapons cannot fire standard, live ammunition.

The low-energy cartridge represented by U.S. Pat. No. 5,359,937, in combination with a substitute training barrel, allows normal recoil and cartridge case ejection through a blow-back action. Such a system, when firing appropriate marking cartridges, makes for effective close-range, force-on-force training. This system enhances the realism and training value of interactive scenario tactical training because it allows trainees to use their service weapons in a representative manner in exercises simulating, for example, counter-terrorism, close quarters combat, trench clearing, fighting in wooded areas, urban fighting, and protection of dignitaries.

When firing standard ammunition, with its abundant associated energy, it is necessary in many weapons, particularly hand guns, to lock the barrel to the slide during the beginning of their rearward motion for a period long enough for the projectile to exit the barrel muzzle while the breech is still closed. This allows the chamber pressure to drop before the breech opens to eject the spent cartridge case. A locking mechanism couples the slide and barrel together for the first portion of the recoil, and then releases the slide, usually with the aid of a cam. Thus, in such normal weapons, the barrel recoils, at least partially, with the slide. Upon unlocking, the slide continues its rearward travel while the barrel stops in the proper position to receive the next round from the magazine to be chambered by the slide as it returns to its in-battery position.

In a training barrel it is necessary to omit this breech-lock mechanism and, by so doing, the recoil action becomes pure blow-back of the slide only. This is because there is not sufficient energy in low-energy training cartridges to precipitate sufficient recoil to unlock the barrel and the slide in their standard configurations. A training barrel of the type addressed by this invention is similar in most aspects to the standard service barrel for a particular pistol which normally relies on a barrel locking mechanism, but is modified, in part, by removing the locking mechanism that holds the barrel and slide together for the first portion of the recoil cycle. Thus, upon firing, the slide is free to move rearwards from its in-battery position unencumbered by the barrel. By so doing, maximum energy is transferred to the slide, thereby contributing to reliable weapon function.

In some 9 mm pistols, however, after the locking mechanism has been removed so that the weapon can fire low-energy ammunition as represented by U.S. Pat. No. 5,359,937, the training barrel does not or cannot move rearward far enough after firing to be in its proper position to receive the next round to be chambered. This happens precisely because the barrel is no longer locked to the slide, which would normally carry the barrel to the correct position before unlocking and leaving it there.

One way to solve this problem is described in PCT Application No. PCT/CA97/00174 (filed Mar. 14, 1997) for semi-automatic pistols such as the Walther P-5 in which the recoil spring(s) are not positioned beneath the barrel. In such instances, a spring-loaded Barrel Positioning Mechanism may be attached to one or more of the lugs of the training barrel, thereby ensuring that the barrel is moved sufficiently rearward when the breech is open to reliably chamber the next cartridge to be fired.

In other automatic pistols, however, the location of the recoil spring under the training barrel precludes such a solution for correctly locating the barrel for reliable chambering of the next cartridge to be fired. In some instances, as in the present invention, the training barrel is fixed with respect to the frame (receiver). It is, therefore, an object of this invention to provide a training barrel system for this class of firearms that will ensure the proper chambering of the next cartridge to be fired.

The concept of converting a pistol so that it can fire low-energy ammunition, as represented by U.S. Pat. No. 5,359,937, requires replacing the service barrel by a training barrel without modifying the slide or the frame. In this way, the weapon can be rapidly reconverted to fire live ammunition again by removing said training barrel and reinstalling said service barrel. Other minor modifications may be necessary (e.g., to the firing pin) but they, too, can be quickly reverted to their original configurations. It is, therefore, another objective of this invention to provide a training barrel system for this class of training firearm that will allow quick and easy assembly of the training barrel without modification to either the frame or the slide.

The invention in its general form will first be described, and then its implementation in terms of specific embodiments will be detailed with reference to the drawings following hereafter. These embodiments are intended to demonstrate the principal of the invention and the manner of its implementation. The invention in its broadest and more specific forms will be further described, and defined, in each of the individual claims which conclude the specification.

SUMMARY OF THE INVENTION

This invention is directed to certain semi-automatic pistols, especially those where the recoil spring is located under the barrel, which are adapted to fire low-energy training ammunition by the substitution of a training barrel that omits the breech-lock feature normally present and is fixed to the frame. It provides a system for ensuring proper chambering of ammunition by fitting a non-integral removable ramp extension to the breech end of the training barrel, such extension extending rearward towards the top of the magazine in such a fashion as to allow smooth passage from the magazine to the chamber of the next round to be fired. Without this ramp extension, the barrel breech would be too far forward from the top of the magazine and the incoming cartridge would not necessarily enter the chamber cleanly, hence provoking a weapon jam whenever such misalignment should occur.

According to the invention, a firearm is provided with a slide and a training barrel which at no time are locked together during the firing cycle. The training barrel, which is fixed with respect to the frame, is provided with a removable feed ramp extension protruding rearward from the barrel towards the magazine. The length of this extension is such that its rearward end is sufficiently close to the top of the magazine that, when it is time to chamber the next round to be fired, the nose of the round is guided smoothly into the chamber by the extension as the slide moves forward into the firing position.

The feed ramp extension is removable so as to allow the training barrel/feed ramp extension to be assembled into the slide and frame without modification to either the slide or the frame. Being removable, the feed ramp extension is necessarily non-integrally formed with the barrel. Conveniently, some barrel designs include a protrusion in the form of a rear lug into which the feed ramp extension may be fitted. By forming a groove on the underside of the barrel, rearwardly of the protrusion, an interfitting, removable feed ramp extension may be inserted therein for lateral confinement in conjunction with the protrusion. A feed ramp extension so removably fitted to the rear lug of a training barrel constitutes an ammunition chambering mechanism in accordance with the present invention.

The rear lug on a barrel of a typical weapon addressed by the invention will usually abut at its forward end the barrel locking pin, which is an integral part of the frame (receiver). When the weapon is ready to fire, the training barrel is at its farthest forward position and is held there against the locking pin by the slide. When firing occurs, the slide recoils but the barrel does not move, being fixed to the frame. Because it cannot move rearward, the barrel is not in an optimum position when the slide reaches its maximum rearward travel and it is time to chamber the next round from the magazine. To correct this unfavourable situation, the gap between the top of the magazine and the entrance to the chamber is, according to the invention, filled by the feed extension ramp, which smoothly guides the round forward into the chamber as the slide returns to close the breech.

Without the feed ramp extension being present, and without the barrel moving rearward upon firing, the gap between the entrance to the chamber at the rear face of the barrel and the top of the magazine would be too great to ensure that the incoming cartridge would reliably enter the chamber without jamming.

A preferred way of fitting the feed ramp extension into the rear lug of the training barrel is to form a rearward facing slot or recess in the lug which will match, receive and contain the forward portion of the extension. The rearward end of the extension, in the form of a smooth concave groove with a diameter approximately that of the outer diameter of the cartridge case of the ammunition to be chambered, will then protrude downwards and rearwards at such an angle, and be of such length, that its rearward face falls just short of, and slightly below, the top of the magazine to guide the next round to be chambered.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
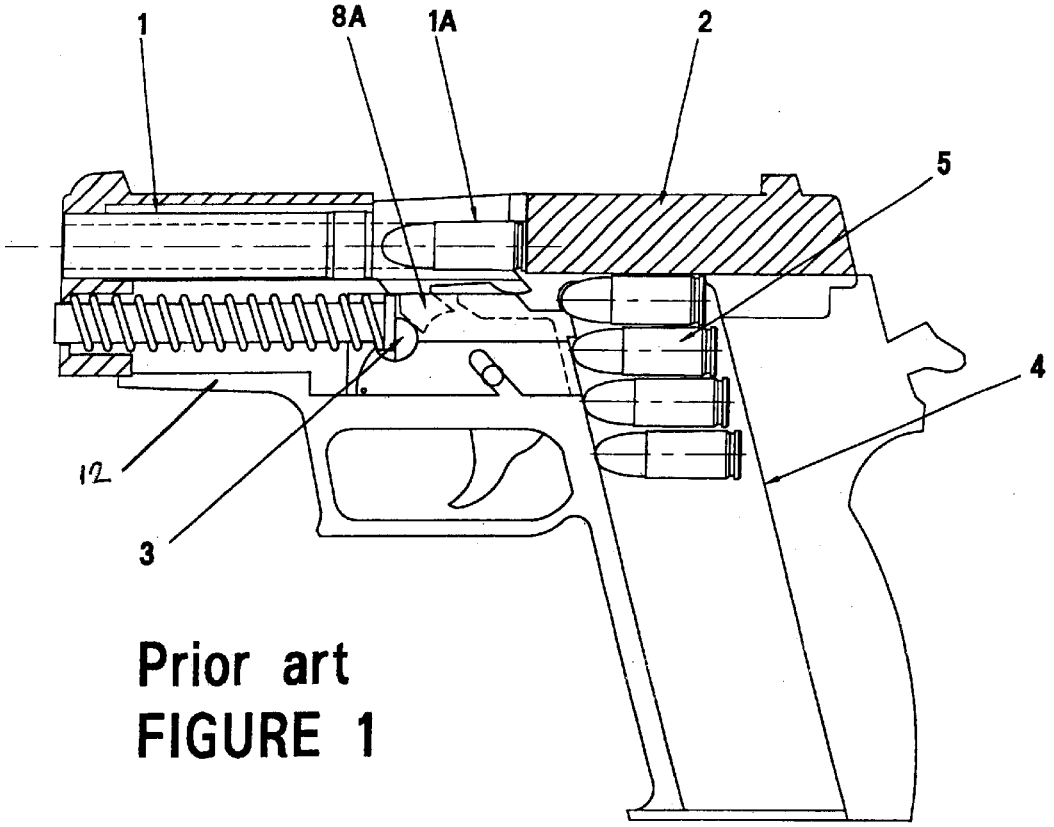
Prior art FIGURE 1
FIG. 1 is a partially cutaway, cross-sectional side view of a prior art pistol ready to fire standard 9 mm ammunition.
Figure 2:
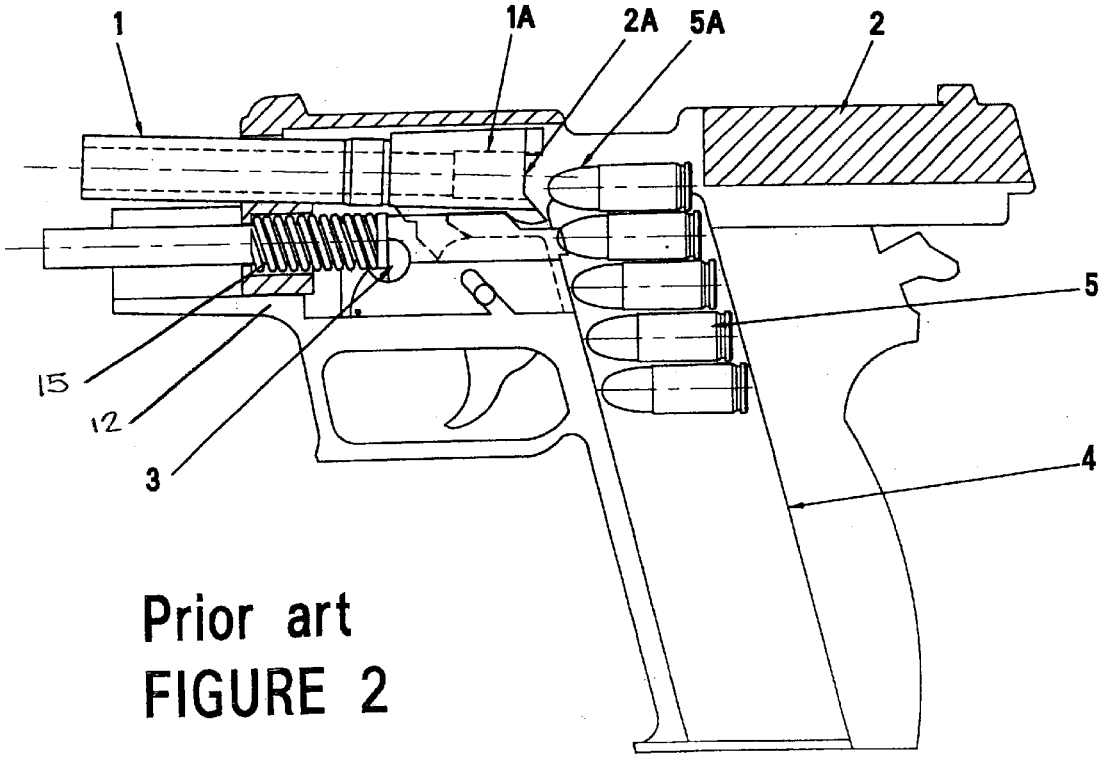
Prior art FIGURE 2
FIG. 2 is a partially cutaway, cross-sectional side view of the same prior art pistol as in FIG. 1 with the slide in its most rearward position, ready to be moved forward by the slide recoil spring. The spent case from the cartridge of FIG. 1 after firing has been ejected from the weapon and the next cartridge from the magazine is in position to be chambered by the returning slide.

In FIG. 1 a prior art 9 mm pistol is shown having barrel 1 and slide 2 with normal locking between the two components, and magazine 4 containing standard service ammunition 5. The weapon is ready to fire with a cartridge 5 chambered in chamber 1A and slide 2 all the way forward, and the barrel lug 8A resting against the locking pin 3. After the weapon is fired, the slide 2 recoils with the barrel following, compressing recoil spring 15. FIG. 2 depicts the prior art barrel in its most rearward position with the spent case from the round just fired already ejected from the weapon and the next round to be chambered having been thrust upwards by magazine 4 almost into line with chamber 1A while awaiting the return of slide 2 to push it forward into chamber 1a and close breech 2A. The nose 5A of the projectile of cartridge 5 to be chambered is very close to the entrance or breech 2A of chamber 1A, and hence will experience no difficulty in smoothly moving forward into chamber 1A for proper chambering. Barrel 1 is so propitiously placed because it has been carried back to this position from locking pin 3 within frame 12 by slide 2, to which it was locked during the first portion of the firing cycle.

Figure 3:
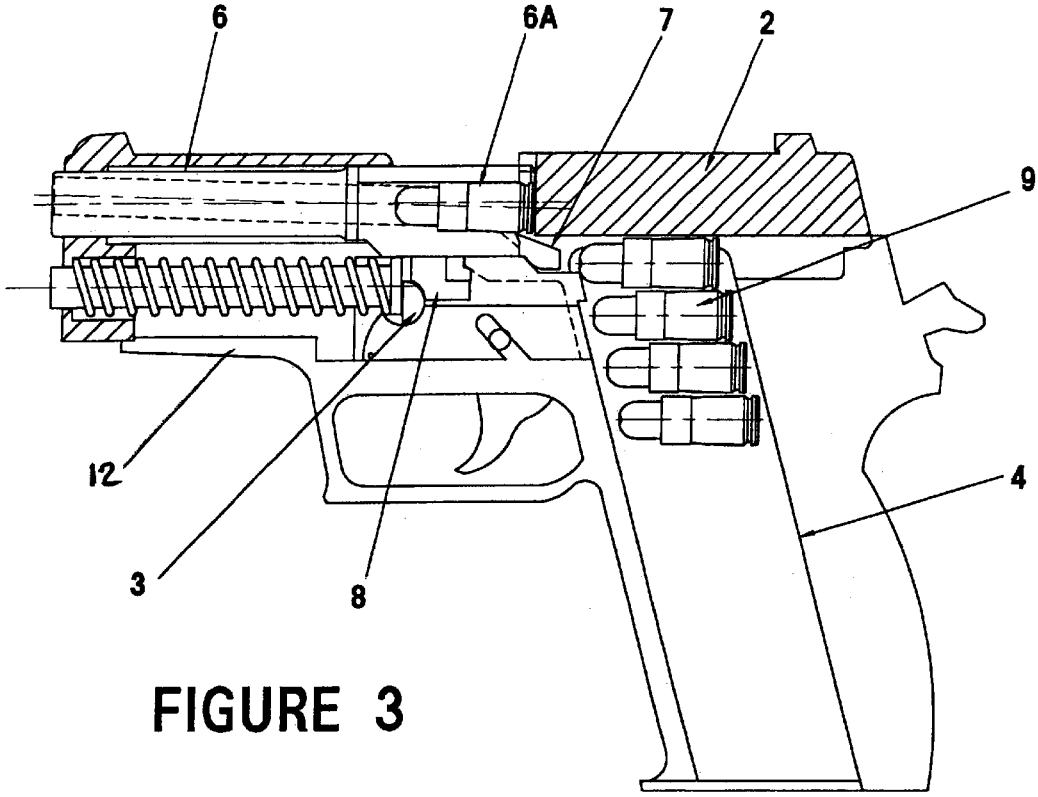
FIG. 3 is the same side view cross-section of the same pistol as in FIG. 1 except that it now contains a non-recoiling training barrel, complete with the ammunition chambering mechanism of the invention, and is ready to fire low-energy ammunition as represented by U.S. Pat. No. 5,359,937.
Figure 4:
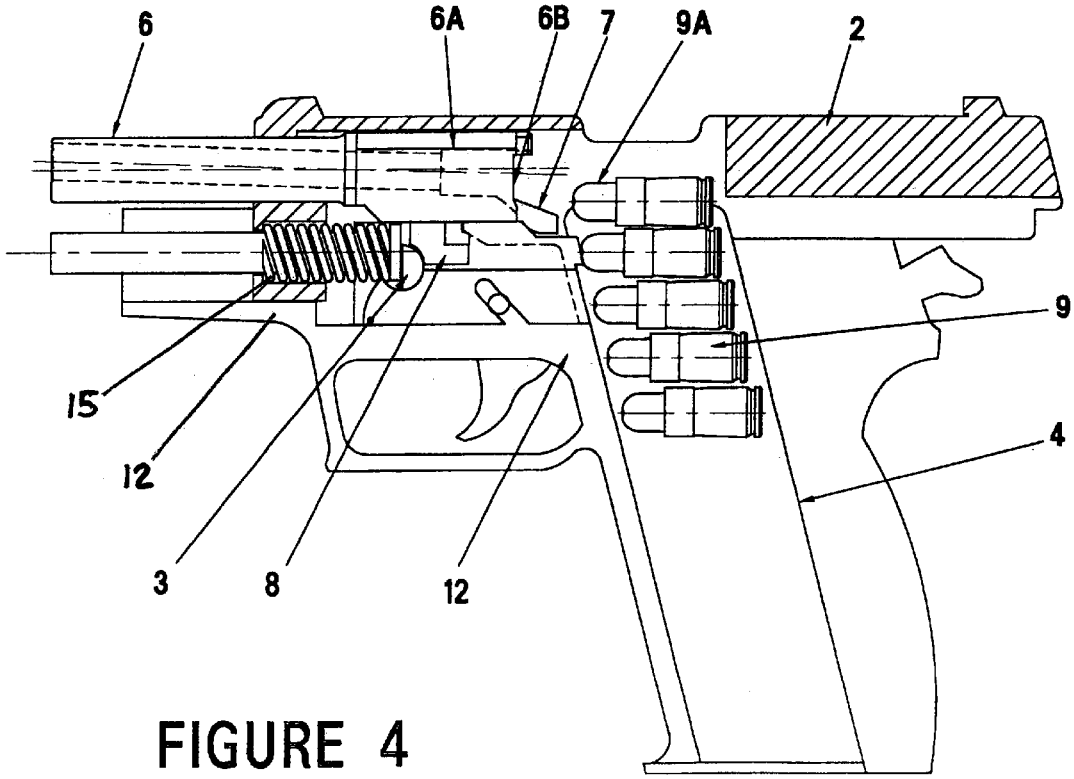
FIG. 4 shows the pistol of FIG. 3 after firing with the slide in its most rearward position, ready to be moved forward by the slide recoil spring. The spent case from the cartridge of FIG. 3 after firing has been ejected from the weapon and the next cartridge from the magazine is in position to be chambered by the returning slide.

When this pistol is converted to telescopically expanding low-energy ammunition 9 as represented by U.S. Pat. No. 5,359,937, barrel 1 is replaced by training barrel 6 in conjunction with feed ramp extension 7, as shown in FIG. 3 with the pistol ready to fire (as in FIG. 1). Similarly, FIG. 4 depicts the same situation for the training configuration of the weapon as does FIG. 2 for the standard weapon except that the barrel has not recoiled. Again, slide 2 is fully rearward and the next round of training ammunition 9 is in position to be chambered by the returning slide 2 moving under the urging of the resilient spring 15. Since training barrel 6 does not move rearwards during firing, remaining abutted against locking pin 3 within frame 12, the resulting large gap between the breech 6B and the nose 9A of the projectile of cartridge 9 to be chambered is filled by feed ramp extension 7. Round 9 will, therefore, be smoothly guided by extension 7 into chamber 6A when slide 2 moves forward to chamber round 9 and close breech 6B.

Figure 5:
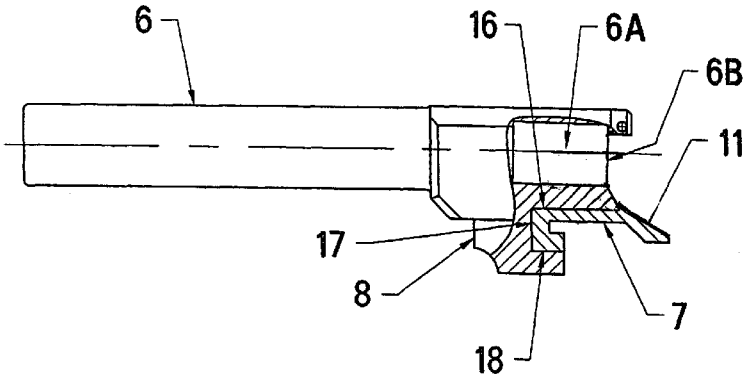
FIG. 5 shows a partial cutaway side view of the training barrel with its feed ramp extension assembled for the 9 mm Sig 225 pistol.

Feed ramp extension 7 is slidingly fitted into a recess 14 formed within lug or protrusion 8 of training barrel 6 as shown in FIG. 5. The extension 7 has an upwardly facing guide surface 11 which serves to guide a round 9 into position as it is being chambered within barrel 6.

Figure 5A:
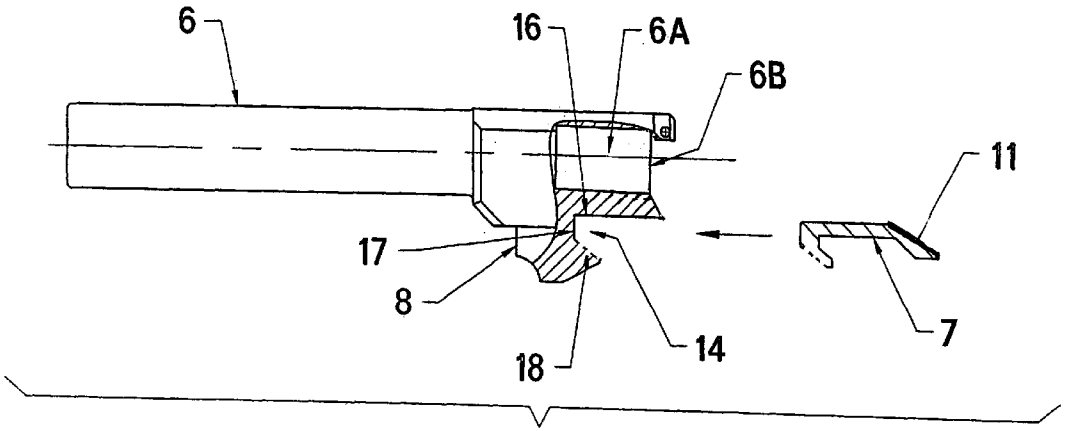
FIG. 5A is an exploded view showing a modified variant of the training barrel of FIG. 5 with a feed ramp extension being inserted. The recess in FIG. 5A has an obliquely, upwardly facing lower containment surface.

The recess 14 is defined by a downwardly-facing first containment surface 16 formed on the underside of the barrel 6, and a rearwardly facing second containment surface 17 carried by the protrusion 8 and providing the vertical interior end of the recess 14. A further, third, generally upwardly oriented containment surface 18 is also carried by the protrusion 8, opposing in part the first containment surface 16. This surface 18 is generally upwardly oriented in that it can either face fully upwards as in FIG. 5, or it may be directed obliquely upwards as in FIG. 5A. Containment surfaces 16 and 18 constrain the ramp 7 against vertical displacement with respect to the barrel 6.

Figure 6:
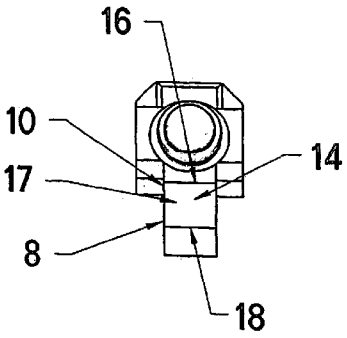
FIG. 6 shows a rear view of the same barrel alone showing the groove into which the feed ramp extension fits.

Lateral movement of the extension 7 in barrel 6 is prevented by its being situated within groove 10 located on the upper side of the recess 14, at the rearward chamber end of barrel 6, as best depicted in FIG. 6. The fit between barrel 6 and extension 7 as it is assembled into recess 14 is necessarily a sliding one to permit the assembly of barrel 6 and extension 7 into slide 2. If the extension 7 were an integral part of the barrel 6, in many weapons assembly would not be possible due to the design of slide 2 and frame 12, which cannot be modified. Longitudinal motion of extension 7, once assembled both in barrel 6 and with slide 2 in place, is restricted at its front end by the second containment surface 17 at the forward end of groove 10; and, at its rearward end, by other portions of the pistol (not shown).

The functioning of the subject ammunition chambering mechanism has been tested many hundreds of times in Sig 225 pistols with complete success and reliability. The ammunition chambering mechanism of the invention is particularly suited for training barrels for such 9 mm semi-automatic pistols as the Sig 225, but also aids in the chambering of training ammunition in modified Sig 226, 228 and 229 pistols as well as being applicable to other semi-automatic firearms that fire low-energy ammunition as represented by U.S. Pat. No. 5,359,937.

CONCLUSION

The foregoing constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A training barrel assembly for an automatic firearm comprising:

(1) a barrel with a forward muzzle, a rearward chamber end having a chamber formed therein and a generally longitudinally-aligned bore;

(2) a protrusion extending downwardly from the barrel proximate to said chamber end to serve as a mounting post for a feed ramp extension, said protrusion having a rearwardly facing recess defined by:

(a) a downwardly-facing first containment surface on the underside of the barrel, rearwardly of said protrusion;

(b) a rearwardly-facing second containment surface carried by said protrusion and defining the vertical interior end of the recess; and (c) a generally upwardly facing third containment surface carried by said protrusion, said third containment surface opposing at least in part said first containment surface to further contain said feed ramp extension against displacement in the vertical direction, and (3) a feed ramp extension which is non-integral with the barrel and the protrusion, said feed ramp extension being positioned within said recess, extending rearwardly therefrom at the chamber end of the barrel, said feed ramp extension having a guide surface for guiding a round as it is being chambered into the barrel, wherein a longitudinally oriented groove is provided within said first containment surface and the feed ramp extension is slidingly fitted into and contained laterally by said groove while abutting against said second and third containment surfaces.

2. The training barrel assembly of claim 1 in combination with a firearm comprising:

(1) a firearm frame carrying said training barrel with the protrusion positioned against the frame to constrain movement of the barrel with respect to the frame;

(2) a slide mounted on the frame free for sliding displacement, independently of the barrel, from an in-battery position when the slide bears against the chamber end of the barrel to a position rearward of the barrel; and (3) resilient means urging the slide forwardly, toward the in-battery position, said feed ramp extension being contained against longitudinal removal from said recess by said frame.

3. The training barrel assembly of claim 2 in combination with a cartridge installed within the chamber end of the barrel.

4. The training barrel assembly of claim 3 wherein the cartridge is a telescopically expanding cartridge.

* * * * *